US006146260A

United States Patent [19]

Yi

[11] Patent Number: 6,146,260

[45] Date of Patent: Nov. 14, 2000

[54] POLISHING MACHINE

[75] Inventor: Champion Yi, Hsinchu, Taiwan

[73] Assignees: ProMos Technology, Inc.; Mosel Vitelic Inc, both of Hsinchu, Taiwan; Siemens AG, Munich, Germany

[21] Appl. No.: 09/128,983

[22] Filed: Aug. 3, 1998

[51] Int. Cl.[7] ..... B24B 37/04

[52] U.S. Cl. ..... 451/398; 451/288

[58] Field of Search ..... 451/288, 287, 451/398, 385, 388, 41

[56] References Cited

U.S. PATENT DOCUMENTS

| | | | |
|---|---|---|---|
| 3,559,346 | 2/1971 | Paola | 451/162 |
| 5,643,061 | 7/1997 | Jackson et al. | 451/288 |
| 5,679,065 | 10/1997 | Henderson | 451/288 |
| 5,695,392 | 12/1997 | Kim | 451/288 |
| 5,906,532 | 5/1999 | Nakajima et al. | 451/287 |

FOREIGN PATENT DOCUMENTS

| | | | |
|---|---|---|---|
| 1034661 | 2/1989 | Japan | 451/63 |

*Primary Examiner*—Robert A. Rose
*Attorney, Agent, or Firm*—W. Wayne Liauh

[57] ABSTRACT

A wafer adapter for a chemical and mechanical polishing (CMP) machine. The adapter includes a retaining ring with multiple grooves formed on one surface of the ring and an inner circle for grasping just a wafer. The grooves have narrower openings at the outer and wider bottoms at the inner circle of the ring. The bottoms are apart from the inner circle with a circular wall. The adapter with wedged grooves served as slurry pools has been proved to have higher polishing efficiency, no wafer lose by sharp edges collision on the wall and less contact pressure between the wafer and the adapter to extend the lifetime of the adapter.

7 Claims, 4 Drawing Sheets

POLISHING MACHINE

BACKGROUND OF THE INVENTION

1. Field of the Invention

The present invention relates to a Chemical-Mechanical Polishing (CMP) machine for polishing semiconductor wafers and, more particularly, to a wafer adapter for adapting a wafer in such a polishing machine.

2. Description of Related Art

CMP is a technology in the process for global planarization of a semiconductor wafer for VLSI (very large scaled integrated circuit) or ULSI (ultra large scaled integrated circuit). It utilizes a mechanical polishing method with a chemical reagent for polishing the surface of the wafer to provide planarity for the outer surface.

Referring to FIG. 1 and FIG. 2, a plane view and a sectional view of a conventional CMP machine are shown, respectively. It includes a polishing table 12 and at least one carrier 14 located upon the table for holding a wafer 10 which will be polished. The carrier 14 further includes a holder 16 and an adapter 24 for grasping the back of a wafer 10 and pressing the exposed surface of the wafer on a polishing pad 18 fixed on the polishing table 12. During the polishing process, the table 12 and the carrier 14 rotate in the opposite directions. There is also a polishing slurry 20 fed via a tube 22 to the table 12. Therefore, the exposed surface of the wafer 10 will be planarized after the polishing process.

Further, referring to FIG. 3, 4, 5 and 6, the configurations of two wafer adapters of prior arts are shown. In FIG. 3 and FIG. 4 (a sectional view taken from line B—B of FIG. 3), the adapter 24 includes a retaining ring 32 with a inner circle for holding a wafer; an unshown fastener such as a screw for fastening the retaining ring 32 to a holder; and a carrier film 34 laid between the ring 32 and the holder 16 to cushion the wafer. Generally, a CMP machine is designed for a specific dimension of wafer. Taking an example of a wafer of eight inch diameter, the adapter 24 for the holder is originally designed in which the inner diameter of the retaining ring 32 is just for grasping such a wafer, and the width T of the ring 32 is just of a few millimeters. The width is so designed in order not to block the transportation of slurry from the polishing pad to the wafer. When a CMP machine of eight inch is required to polish a six inch wafer, a conventional adapter 24 as shown in FIG. 5 and FIG. 6 (a sectional view taken from line C—C of FIG. 5) is used. Since the outer diameter of the retaining ring 32 is restricted to the configuration of the holder, only the inner diameter of the ring is modified. As the inner diameter of the ring 32 is shrank to six inches, there comes a two-inch wide barrier for the slurry transportation. Though there are several straight grooves 36 cut for an easier transportation of the slurry, there are some disadvantages for the conventional adapter:

a) the straight grooves 36 make the slurry flow easily between the wafer and the polishing pad but cannot efficiently hold the slurry during the polishing process, increasing the need of more slurry and decreasing the efficiency of slurry utilization;

b) the straight grooves 36 are ineffective for the slurry distribution and sensitive to the process parameters such as the table rotation speed and the carrier rotation speed;

c) there are sharp comers formed on the wall of the inner circle of the ring due to the grooves 36, which are in contact with the wafer. If the wafer rotates inside the ring during the polishing process, it is possible to have collision between the wafer and these sharp corners, resulting in wafer loss;

d) the straight grooves 36 breaking through the surface of the inner circle of the retaining ring 32 reduce the contact area of the ring to the wafer, therefore reducing the lifetime of the ring due to the smaller contact area and higher contact pressure.

SUMMARY OF THE INVENTION

The present invention therefore provides a wafer adapter for overcoming the aforesaid drawbacks of a conventional smaller size wafer adapter.

The present invention discloses a wafer adapter for a CMP machine. The adapter includes a retaining ring with multiple grooves formed on one surface of the ring. The inner and outer circle of the ring is adapted for grasping just a wafer and the configuration of the holder, respectively. The grooves have narrower openings at the outer circle of the ring and wider bottoms at the inside circle of the ring; and the bottoms are apart from the inner circle with a wall.

The other objectives and features of the present invention will become apparent from the following description of preferred embodiments with reference to the accompanying drawings.

DETAIL DESCRIPTION OF PREFERRED EMBODIMENT

As in the above description, FIG. 1 to FIG. 6 illustrate a CMP machine and wafer adapters of prior arts.

Figure 7:
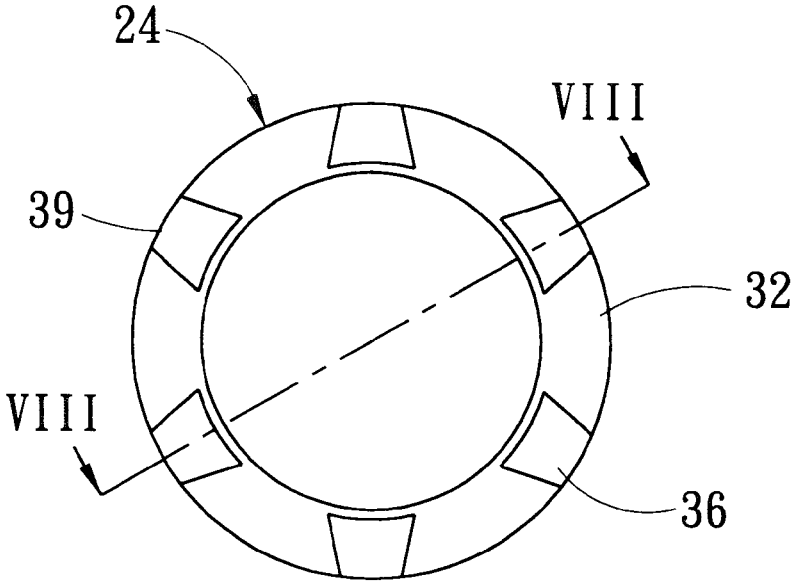
FIG. 7 is a bottom view of a wafer adapter for a CMP machine used for a smaller wafer according to the present invention.
Figure 8:
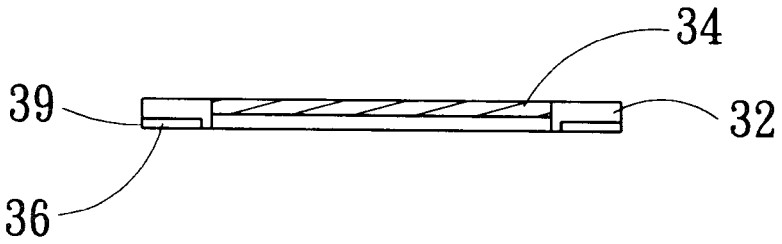
FIG. 8 is a sectional view taken from line D—D of FIG. 7.

FIG. 7 and FIG. 8 illustrate a bottom view and sectional view of a wafer adapter according to the present invention, respectively. The adapter includes a retaining ring 32 for grasping a wafer of smaller size (such as 6 inches diameter) and an unshown fastener such as a screw for fastening the ring to a holder 16 (see FIG. 2) of an original designed larger diameter (such as 8 inches) wafer CMP machine. There are multiple grooves 39 having a bowl-like cross-section formed on the lower surface of the ring 32 the inner surface of the ring 32 defines a cavity which is dimension to just grasp a wafer. The bowl-like grooves 39 have narrower openings 361 at the outer circle and wider bottoms 362 at the inner circle of the ring 32; and the bottoms 362 are apart from the inner circle with a wall 363 having a thickness less than 0.5 centimeters. There is also a carrier film 34 laid between the ring 32 and the holder 16 to cushion the wafer.

The advantages of the wafer adapter according to the present invention will be described as follows.

Firstly, by having a wedge shape (the narrower opening and the wider bottom) of the grooves:

a) higher polishing efficiency will be achieved as the slurry coming into the wedged grooves will be retained for a longer period of time and better utilized in the polishing process;

b) original CMP process parameters such as the table and carrier rotation speeds will be maintained as the wedged grooves are formed as slurry pools which will maintain the flow of slurry between the wafer and the polishing pad.

Figure 1:
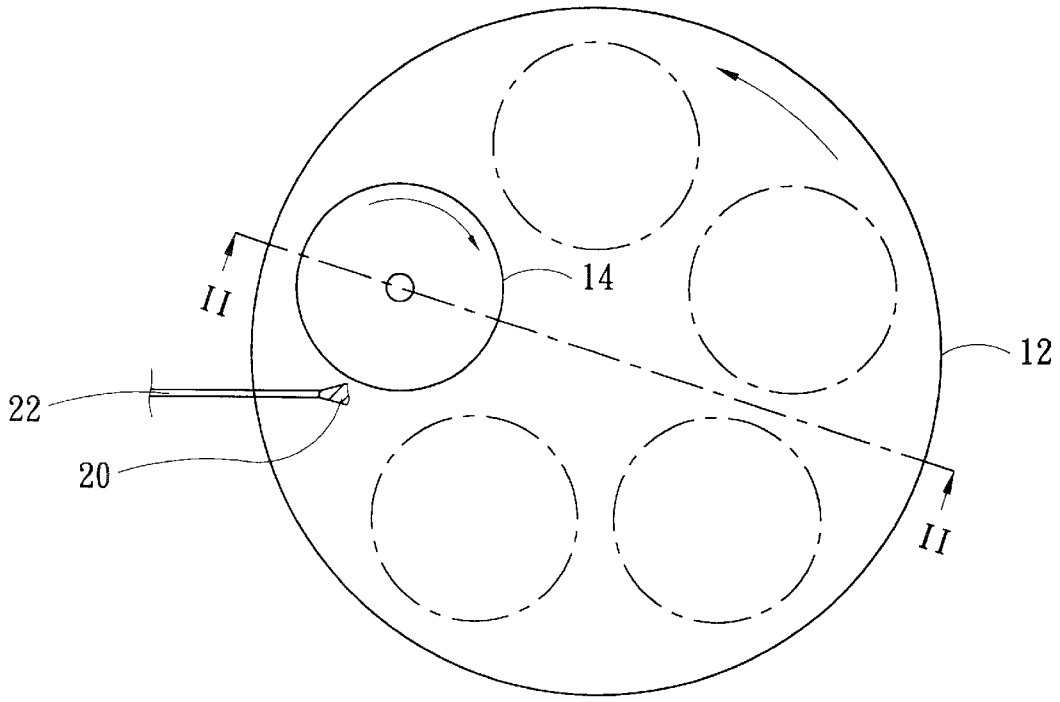
FIG. 1 is a partial top view of a conventional CMP machine.
Figure 2:
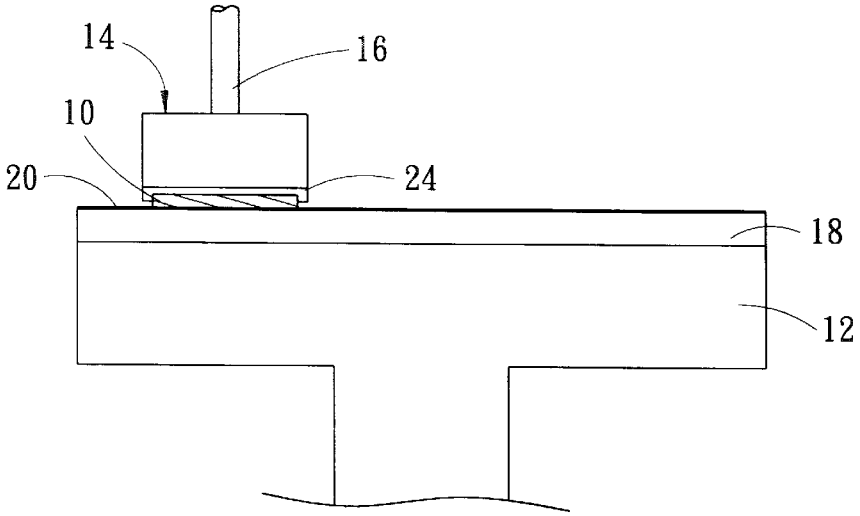
FIG. 2 is a sectional view taken from line A—A of FIG. 1.
Figure 3:
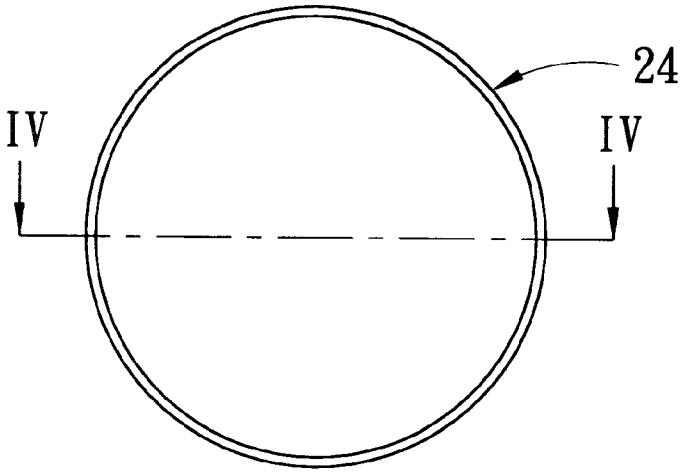
FIG. 3 (PRIOR ART)
FIG. 3 is a bottom view of a conventional wafer adapter for a CMP machine originally used for a larger wafer.
Figure 4:
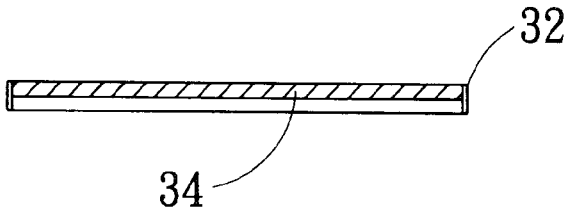
FIG. 4 (PRIOR ART)
FIG. 4 is a sectional view taken from line B—B of FIG. 3.
Figure 5:
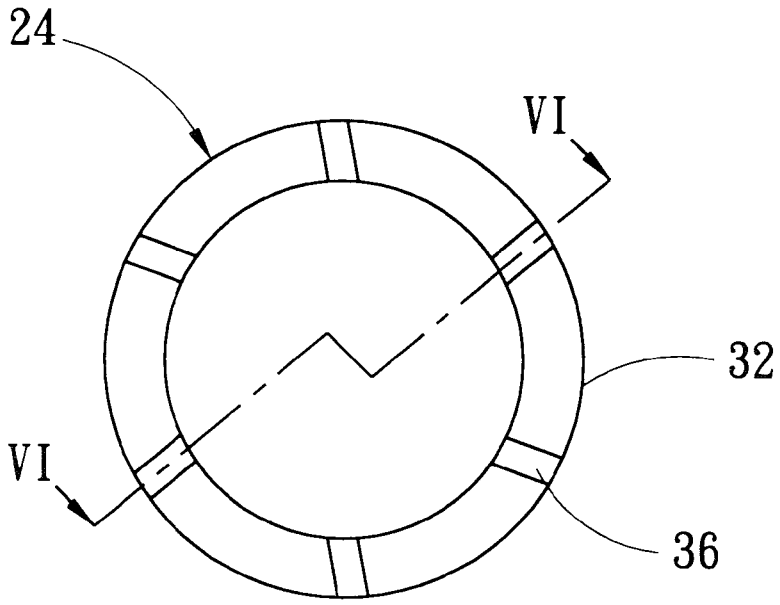
FIG. 5 (PRIOR ART)
FIG. 5 is a bottom view of a conventional wafer adapter for a CMP machine used for a smaller wafer.
Figure 6:
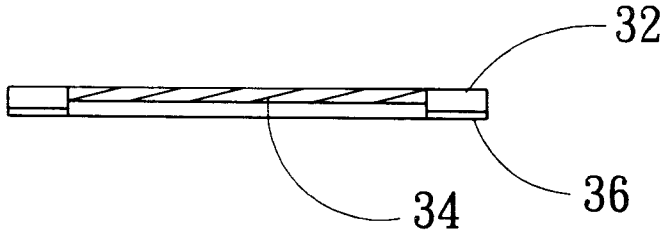
FIG. 6 (PRIOR ART)
FIG. 6 is a sectional view taken from line C—C of FIG. 5.

Secondly, by maintaining a whole circular wall as shown for holding the wafer as in FIG. 7 instead of broken walls cut by grooves as in FIG. 5:

a) the wafer will not be damaged because no sharp edges are formed in contact with the wafer;

b) the lifetime of the adapter will be extended since the contact pressure between the wafer and the adapter is decreased by the whole wall.

By experiments, it has been proved that an adapter according to the present invention gets great performance: the demanded flow amount of the slurry is reduced from 500~1000 cc/min of a conventional adapter to only 150~500 cc/min of the present invention for the same result of polishing process.

It is intended that the foregoing detailed description be regarding as illustrative rather than limiting, and that it be understood that it is the following claims, including all equivalents, which are intended to define the scope of this invention.

What is claimed is:

1. An adapter for holding a wafer to a holder of a chemical-mechanical polishing machine, comprising:

a retaining ring, having a plurality of grooves formed on one surface thereof, and an inner and outer circle thereof being adapted for grasping said wafer and the holder, respectively, wherein said grooves are open at said outer circle and closed from said inner circle by a wall;

further wherein said grooves are formed with narrower openings at said outer circle of said ring.

2. An adapter for holding a wafer to a holder of a chemical-mechanical polishing machine, comprising:

a retaining ring, having a plurality of grooves formed on one surface thereof, and an inner and outer circle thereof being adapted for grasping said wafer and the holder, respectively, wherein said grooves are open at said outer circle and closed from said inner circle by a wall;

further wherein said grooves have narrower openings at said outer circle and wider bottoms at said inner circle of said ring.

3. An adapter for holding a wafer to a holder of a chemical-mechanical polishing machine, comprising:

a retaining ring, having a plurality of grooves formed on one surface thereof, and an inner and outer circle thereof being adapted for grasping said wafer and the holder, respectively, wherein said grooves are open at said outer circle and closed from said inner circle by a wall;

further wherein said grooves are in a wedge shape.

4. An adaptor for holding a wafer to a holder of a chemical-mechanical polishing machine according to claim 1, wherein said wall formed between said grooves and said inner circle has a thickness less than 0.5 centimeters.

5. An adaptor for holding a wafer to a holder of a chemical-mechanical polishing machine according to claim 1 wherein said wall formed between said grooves and said inner circle has a thickness less than 0.5 centimeters.

6. An adapter holding a wafer to a holder of a chemical-mechanical polishing machine according to claim 1, further comprises a carrier film laid between said ring and said holder to cushion said wafer.

7. An adaptor for holding a wafer to a holder of a chemical-mechanical polishing machine according to claim 1 said ring is fastened to said holder by a screw.

* * * * *